US009722330B2

(12) United States Patent
Edmonds et al.

(10) Patent No.: US 9,722,330 B2
(45) Date of Patent: Aug. 1, 2017

(54) POST-LESS COAXIAL CABLE CONNECTOR WITH COMPRESSION COLLAR

(71) Applicant: PCT International, Inc., Mesa, AZ (US)

(72) Inventors: Samuel S. Edmonds, Gilbert, AZ (US); Brandon Wilson, Phoenix, AZ (US); Timothy L. Youtsey, Tempe, AZ (US)

( * ) Notice: Subject to any disclaimer, the term of this patent is extended or adjusted under 35 U.S.C. 154(b) by 0 days.

(21) Appl. No.: 15/293,065

(22) Filed: Oct. 13, 2016

(65) Prior Publication Data

US 2017/0104280 A1 Apr. 13, 2017

Related U.S. Application Data

(60) Provisional application No. 62/241,105, filed on Oct. 13, 2015.

(51) Int. Cl.

| | |
|---|---|
| ***H01R 9/05*** | (2006.01) |
| ***H01R 24/38*** | (2011.01) |
| *H01R 103/00* | (2006.01) |

(52) U.S. Cl.

CPC ..... *H01R 9/0518* (2013.01); *H01R 24/38* (2013.01); *H01R 2103/00* (2013.01)

(58) Field of Classification Search

CPC .. H01R 9/0518; H01R 24/38; H01R 2103/00; H01R 9/05; H01R 9/0524; H01R 13/5825

USPC ..... 439/585, 460, 578, 583, 584

See application file for complete search history.

(56) References Cited

U.S. PATENT DOCUMENTS

| | | | | |
|---|---|---|---|---|
| 3,199,061 | A | 8/1965 | Johnson et al. | |
| 4,377,320 | A | 3/1983 | Lathrop et al. | |
| 4,990,106 | A | 2/1991 | Szegda | |
| 5,466,173 | A * | 11/1995 | Down | H01R 9/0518 439/578 |
| 5,498,175 | A | 3/1996 | Yeh et al. | |
| 5,501,616 | A | 3/1996 | Holliday | |
| 5,632,651 | A | 5/1997 | Szegda | |
| 6,010,289 | A | 1/2000 | Distasio et al. | |
| 6,042,422 | A * | 3/2000 | Youtsey | H01R 9/0518 439/585 |
| 6,425,782 | B1 | 7/2002 | Holland | |
| 6,648,683 | B2 | 11/2003 | Youtsey | |
| 6,712,631 | B1 | 3/2004 | Youtsey | |
| 6,767,248 | B1 * | 7/2004 | Hung | H01R 13/5205 439/578 |
| 7,144,272 | B1 | 12/2006 | Burris et al. | |
| 7,364,462 | B2 | 4/2008 | Holland | |

(Continued)

*Primary Examiner* — Tulsidas C Patel
*Assistant Examiner* — Travis Chambers
(74) *Attorney, Agent, or Firm* — Thomas W. Galvani, P.C.; Thomas W. Galvani

(57) ABSTRACT

A coaxial cable connector includes an inner barrel having a longitudinal axis, a front end, a rear end, and a compression band between the front and rear ends. A compression collar is mounted to the inner barrel for axial movement over the inner barrel from a retracted position to an advanced position. An inner post of the connector has opposed front and rear ends, and the front end of the inner barrel is carried at and on the rear end of the inner post. In response to axial movement of the compression collar over the inner barrel, the compression band compresses inward. When a cable is applied to the connector and the compression collar is moved axially forward over the inner barrel, the connector is permanently secured to the cable.

24 Claims, 4 Drawing Sheets

(56) References Cited

U.S. PATENT DOCUMENTS

| | | | | |
|---|---|---|---|---|
| 7,377,809 | B2 | 5/2008 | Dyck | |
| 7,404,737 | B1 | 7/2008 | Youtsey | |
| 7,510,432 | B2 | 3/2009 | Entsfellner | |
| 7,527,524 | B1 | 5/2009 | Coleman et al. | |
| 7,753,727 | B1 | 7/2010 | Islam et al. | |
| 7,934,953 | B1 | 5/2011 | Solis | |
| 7,976,339 | B2 | 7/2011 | Buck et al. | |
| 8,029,316 | B2 | 10/2011 | Snyder et al. | |
| 8,444,433 | B2 | 5/2013 | Snyder et al. | |
| 8,469,739 | B2 | 6/2013 | Rodrigues et al. | |
| 8,550,835 | B2 * | 10/2013 | Montena | H01R 9/05 439/322 |
| 8,556,656 | B2 * | 10/2013 | Thomas | H01R 9/0521 439/584 |
| 8,579,658 | B2 * | 11/2013 | Youtsey | H01R 9/05 439/578 |
| 8,632,360 | B2 * | 1/2014 | Tremba | H01R 9/0524 439/578 |
| 8,690,603 | B2 | 4/2014 | Bence et al. | |
| 8,753,147 | B2 | 6/2014 | Montena | |
| 8,840,429 | B2 * | 9/2014 | Thomas | H01R 9/0521 439/584 |
| 8,894,440 | B2 | 11/2014 | Rodrigues et al. | |
| 8,915,751 | B2 | 12/2014 | Wood | |
| 8,920,192 | B2 * | 12/2014 | Montena | H01R 9/05 439/320 |
| 8,944,846 | B2 | 2/2015 | Lee | |
| 9,039,446 | B2 | 5/2015 | Youtsey | |
| 9,071,019 | B2 | 6/2015 | Burris et al. | |
| 9,083,113 | B2 | 7/2015 | Wild et al. | |
| 9,130,281 | B2 | 9/2015 | Phillips, Jr. et al. | |
| 9,257,780 | B2 | 2/2016 | Thomas et al. | |
| 2002/0164900 | A1 | 11/2002 | Youtsey | |
| 2004/0048514 | A1 | 3/2004 | Kodaira | |
| 2005/0148236 | A1 | 7/2005 | Montena | |
| 2007/0093128 | A1 | 4/2007 | Thomas et al. | |
| 2009/0053928 | A9 | 2/2009 | Entsfellner | |
| 2010/0261380 | A1 | 10/2010 | Skeels et al. | |
| 2010/0297875 | A1 | 11/2010 | Purdy et al. | |
| 2012/0021642 | A1 | 1/2012 | Zraik | |
| 2012/0045933 | A1 * | 2/2012 | Youtsey | H01R 9/05 439/578 |
| 2012/0129387 | A1 * | 5/2012 | Holland | H01R 13/622 439/578 |
| 2012/0270439 | A1 | 10/2012 | Tremba et al. | |
| 2012/0329311 | A1 | 12/2012 | Duval et al. | |
| 2013/0330967 | A1 | 12/2013 | Youtsey | |
| 2014/0342594 | A1 | 11/2014 | Montena | |
| 2015/0050825 | A1 | 2/2015 | Krenceski et al. | |
| 2015/0118901 | A1 | 4/2015 | Burris | |
| 2015/0162675 | A1 | 6/2015 | Davidson, Jr. et al. | |
| 2015/0180141 | A1 | 6/2015 | Wei | |
| 2015/0229044 | A1 | 8/2015 | Youtsey | |
| 2015/0340778 | A1 * | 11/2015 | Chastain | H01R 9/0527 439/578 |

* cited by examiner

POST-LESS COAXIAL CABLE CONNECTOR WITH COMPRESSION COLLAR

CROSS-REFERENCE TO RELATED APPLICATIONS

This application claims the benefit of U.S. Provisional Application No. 62/241,105, filed Oct. 13, 2015, which is hereby incorporated by reference.

FIELD OF THE INVENTION

The present invention relates generally to electrical apparatuses, and more particularly to coaxial cable connectors.

BACKGROUND OF THE INVENTION

Coaxial cables carry radio frequency ("RF") signals between transmitters and receivers and are used to interconnect televisions, cable boxes, DVD players, satellite receivers, modems, and other electrical devices. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be fit with cable connectors to be coupled to electrical devices. Connectors typically have a connector body, a threaded fitting mounted for rotation on an end of the connector body, a bore extending into the connector body from an opposed end to receive the coaxial cable, and an inner post within the bore coupled in electrical communication with the fitting. Generally, connectors are crimped with a tool onto a prepared end of a coaxial cable to secure the connector to the coaxial cable. Conventional crimping is a convenient method of applying a connector to a cable, but other methods are desired for improved methods of connecting, reducing materials, and providing quick installation without compromising the integrity and quality of the connection.

SUMMARY OF THE INVENTION

A coaxial cable connector includes an inner barrel having a longitudinal axis, a front end, a rear end, and a compression band between the front and rear ends. A compression collar is mounted to the inner barrel for axial movement over the inner barrel from a retracted position to an advanced position. An inner post of the connector has opposed front and rear ends, and the front end of the inner barrel is carried at and on the rear end of the inner post. In response to axial movement of the compression collar over the inner barrel, the compression band compresses inward. When a cable is applied to the connector and the compression collar is moved axially forward over the inner barrel, the connector is permanently secured to the cable.

BRIEF DESCRIPTION OF THE DRAWINGS

Referring to the drawings.

DETAILED DESCRIPTION

Figure 1:
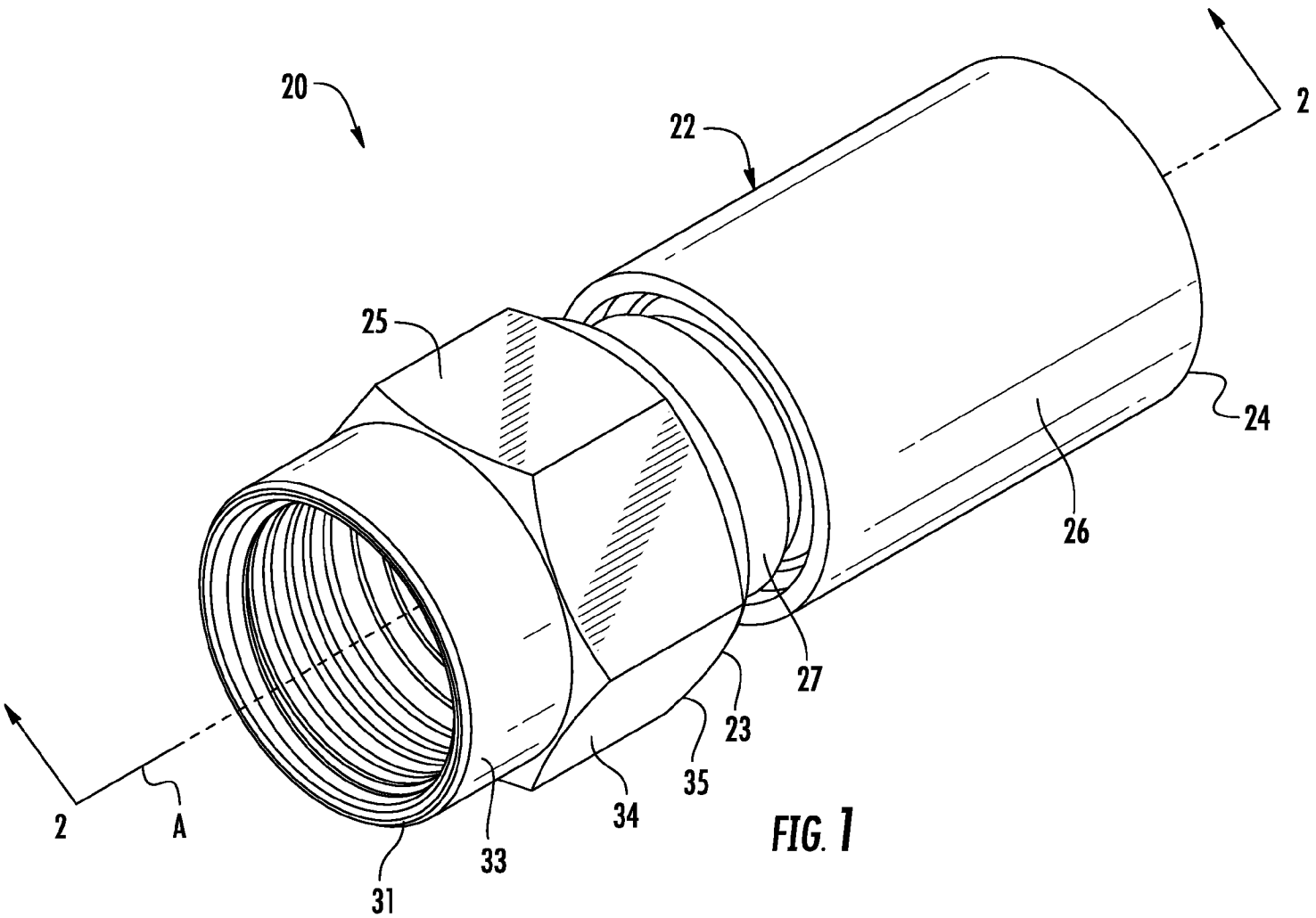
FIG. 1 is a perspective view of a coaxial cable connector in an uncompressed condition.

Reference now is made to the drawings, in which the same reference characters are used throughout the different figures to designate the same elements. FIG. 1 illustrates a coaxial cable connector 20 as it would appear in an uncompressed condition free of a coaxial cable. The embodiment of the connector 20 shown is an F connector for use with an RG6 coaxial cable for purposes of example, but it should be understood that the description below is also applicable to other types of coaxial cable connectors and other types of cables. The connector 20 includes a body 22 having opposed front and rear ends 23 and 24, a coupling nut 25 mounted for rotation on the front end of the body 22, and a compression collar 26 mounted to the rear end of the body 22. The connector 20 has rotational symmetry with respect to a longitudinal axis A illustrated in FIG. 1.

Figure 2:
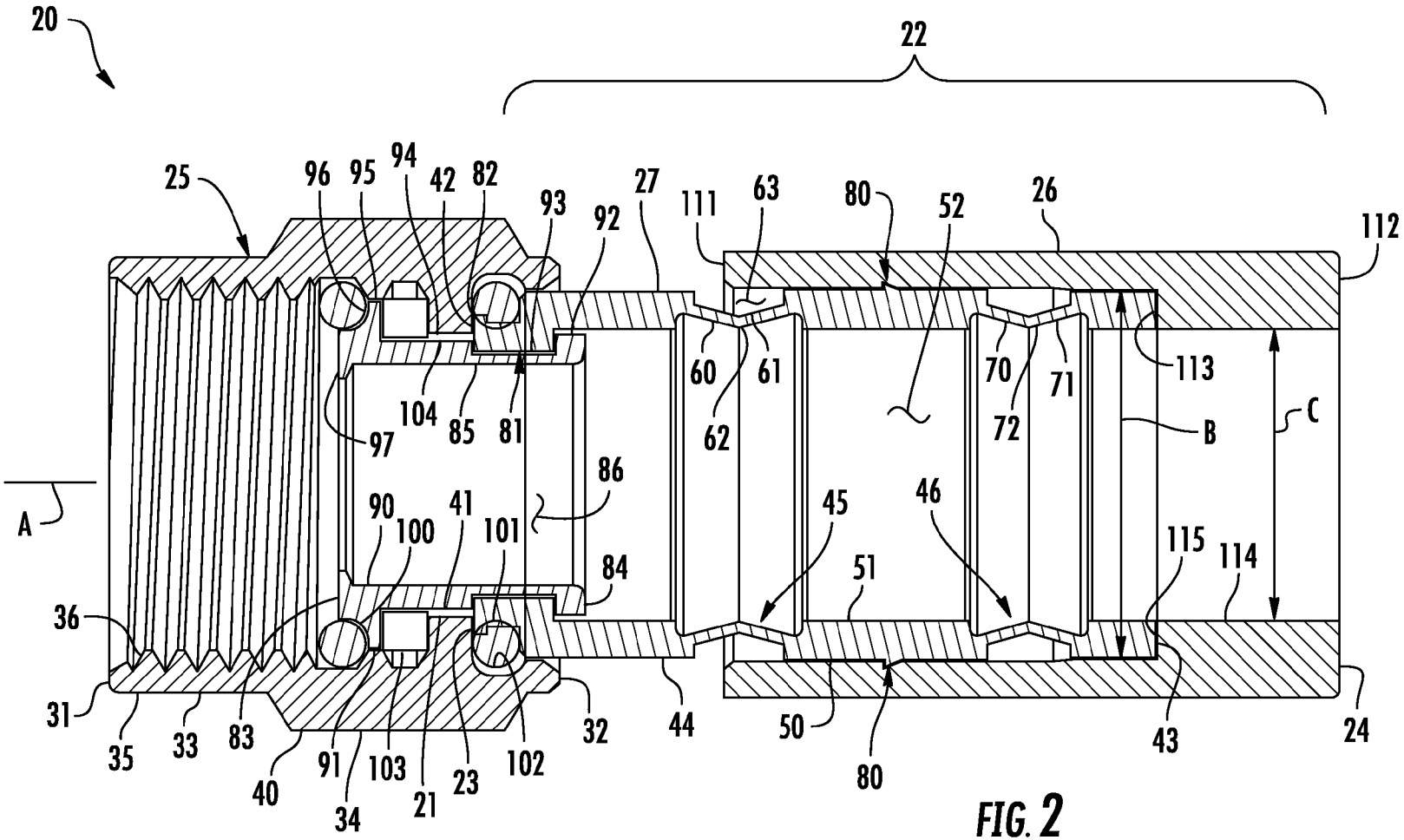
FIG. 2 is a section view of the connector of FIG. 1 taken along the line 2-2 in FIG. 1.

The nut 25 is a sleeve having opposed front and rear ends 31 and 32, an integrally-formed round and smooth ring portion 33 proximate to the front end 31, and an integrally-formed nut portion 34 proximate to the rear end 32. Referring also to FIG. 2, which is a section view of the connector 20 taken along the line 2-2 in FIG. 1, the ring portion 33 has a smooth annular outer surface 35 and an opposed threaded inner surface 36 for engagement with an electrical device. Briefly, as a matter of explanation, the phrase "electrical device," as used throughout the description includes any electrical device having a female post to receive a male coaxial cable connector 20 for the transmission of RF signals such as cable television, satellite television, internet data, and the like.

The nut portion 34 of the nut 25 has a hexagonal outer surface 40 to receive the jaws of a tool and an opposed grooved inner surface 41 to receive gaskets and to engage with the body 22 of the connector 20 and a post 21 of the connector 20. The nut portion 34 of the nut 25 is mounted at and on the front end 23 of the body 22 for free rotation of the nut 25 about axis A. The nut 25 is constructed of a material or combination of materials having strong, hard, rigid, durable, and high electrically-conductive material characteristics, such as metal.

With continuing reference to FIG. 2, the body 22 of the connector 20 is an assembly including the compression collar 26 which is mounted on a cylindrical inner barrel 27, which in turn is mounted on the post 21. The compression collar 26, the inner barrel 27, and the post 21 are all coaxial and registered along the axis A. Referring now to FIG. 2, the inner barrel 27 has opposed front and rear ends 42 and 43, an annular sidewall 44 extending between the front and rear ends 42 and 43, and two compression bands 45 and 46 formed in the sidewall 44 between the front and rear ends 42 and 43 of the inner barrel 27. As the term is used in this description only herein, a "compression band" is an annular structure that reduces or is reduced in dimension in response to compression or deformation of the compression band itself. The inner barrel 27 has a smooth annular outer surface 50 and an opposed smooth annular inner surface 51. A bore 52 is bound by the inner surface 51 and is shaped and sized to receive a coaxial cable through the open rear end 43. The inner barrel 27 is constructed of a material or combination of materials having strong, hard, rigid, durable, and electrically-conductive material characteristics, such as metal, plastic, and the like.

The compression band 46 is formed in the sidewall 44 proximate to the rear end 43, and the compression band 45 is formed in the sidewall 44 at a location generally intermediate between the front and rear ends 42 and 43. The compression band 45 is identified herein as a "forward" compression band, and the compression band 46 is identified herein as a "rear" compression band, as the rear compression band 46 is closer to the rear end 43 of the inner barrel 27 than the forward compression band 45 is. Briefly, it is noted that the terms "forward," "front," "in front of," and the like indicate that an element is closer to the front end 31 of the nut 31, and the terms "rearward," "back," "behind," and the like indicate that an element is closer to the rear end 24 of the body 22. The structure of the compression bands 45 and 46 is identical; each defines a narrowed, notched portion of the sidewall 44 extending into the bore 52. The compression band 45 includes a first wall portion 60, an opposed second wall portion 61, and a flexible bend 62 at which the first and second wall portions 60 and 61 meet. The first and second wall portions 60 and 61 are rigid, and the bend 62 is a living hinge providing flexibility between the first and second wall portions 60 and 61. The first and second wall portions 60 and 61 are obliquely oriented inwardly toward the axis A. A compression space 63 is defined between the first and second wall portions 60 and 61. Similarly, the rear compression band 46 includes a first wall portion 70, a second wall portion 71, a bend 72 therebetween, and a compression space 73. The first and second wall portions 70 and 71 are obliquely oriented inwardly toward the axis A.

The compression collar 26 is mounted for slidable movement along the longitudinal axis A over the inner barrel 27 to cause the compression bands 45 and 46 to deform axially and radially, collapse axially and radially, and compress axially so as to decrease in axial length. The compression collar 26 is fit at the rear end 43 of the inner barrel 27 and is described in more detail later.

Still referring to FIG. 2, a barb 80 is formed on the outside of the sidewall 44 between the compression bands 45 and 46. The barb 80 is an annular ridge or projection directed toward the front end 42 of the inner barrel 27. The barb 80 prevents retraction of the compression collar 26 once the compression collar 26 has moved forward. In other embodiments, the barb 80 is in the form of several spaced apart, forwardly-directed projections or individual barbs or prongs.

A reduced-diameter cuff 81 is formed at the front end 42 of the inner barrel 27. The cuff 81 contracts radially from the sidewall 44 of the inner barrel and includes an outwardly-directed flange 82 at the front end 42 of the inner barrel 27. The cuff 81 is mounted to the inner post 21 and is preferably fixedly mounted to the inner post 21 to prevent relative rotation between the inner barrel 27 and the inner post 21. Nevertheless, in some embodiments, the cuff 81 is mounted for free rotation on the inner post 21.

The inner post 21 is a coupling between the nut 25 and the inner barrel 27. The inner post 21 is constructed of a material or combination of materials having hard, rigid, durable, and high electrically-conductive material characteristics, such as metal. The inner post 21 provides axial rigidity, especially when the compression collar 26 is advanced over the inner barrel 27. Still referring to FIG. 2, the inner post 21 includes a front end 83, a rear end 84, and a sidewall 85 extending therebetween. The inner post 21 defines a bore 86 which is joined in communication with the bore 52 in the inner barrel 27 and which is joined in communication with the open mouth of the nut 25. The bore 86 is reduced in diameter compared to the bore 52.

The inner post 21 is a cylindrical sleeve having a generally smooth and featureless (excepted as described herein) inner surface 90 and a contoured outer surface 91. An outwardly-directed flange 92 extends radially outward from the inner post 21 at the rear end 84. Proximate to the flange 92, and in part defined by the flange 92, is an annular dado or channel 93 formed into the inner post 21 from the outer surface 91 thereof. The inner barrel 27 is coupled to the inner post 21 at the channel 93, as will be described. In front of the channel 93 is a shoulder 94 that extends to the front end 83 of the inner post 21. Just behind the front end 83, another outwardly-directed flange 95 extends radially outward from the shoulder 94. The flange 95 has a curved front face 96 extending annularly around the inner post 21. Finally, the inner post 21 terminates forwardly at the front end 83 with a radially inwardly-directed lip 97 oriented into the bore 86. The lip 97 acts as a stop to prevent advancement of the coaxial cable through the connector 20.

The inner post 21 is quite short, especially when compared to posts of conventional coaxial cable connectors. Conventional connectors have a long inner post that extends a substantial length of the connector, or in some cases, the entire length of the connector. The rear portion of conventional inner posts are thin cylinders, and the dielectric and center conductor of a cable are passed into the inner post, while the braid, foil layer, and jacket are passed over the inner post but within an outer body. Thus, with conventional connectors, the coaxial cable must be forcibly applied, generally with a tool, to push the cable through the inner post. The cable, disposed both within and outside of the conventional inner post, is sandwiched and compressed, and the conventional connector is thus rendered dense and rigid. However, a tool is generally needed to apply the cable to the conventional connector. Here, the shortness of the inner post 21 allows much easier introduction and application of a cable to the connector 20. The rear end 84 of the inner post 21 terminates just behind coupling nut and is just slightly more behind the front end 42 of the inner barrel 27. The front end 42 of the inner barrel 27 is as such mounted both at and on the rear end 84 of the inner post 21. Because there is no long rear portion of the inner post 21 which extends through the bore 52, the cable does not need to be forcibly applied. Indeed, the bore 52 is a continuous and uninterrupted void defined within the inner barrel 27 because there is no portion of the inner post which extends into the bore 52, and there is nothing in the bore 52 other than the void, so the bore 52 is ready to receive a prepared coaxial cable therein.

The inner barrel 27 is securely coupled to the inner post 21. The annular cuff 81 of the inner barrel 27 is seated into the annular channel 93 of the inner post 21. The flange 92 prevents rearward axial movement of the inner barrel 27 out of the channel 93 off the inner post 21, and the shoulder 94 prevents forward axial movement of the inner barrel 27 out of the channel 93. Thus, relative axial movement of the inner post 21 and the inner barrel 27 is prevented. As discussed above, the inner barrel is tightly fit onto the inner post 21 to prevent relative rotational movement of the inner post 21 and the inner barrel 27. The cuff 81 is dimensioned, axially and diametrically, to correspond to the channel 93 in the inner post 21.

The nut 25 is mounted for free rotation on the inner post 21 about the axis A. To allow free rotation, gaskets 100 and 101 space the nut portion 34 just off the inner post 21 in a radial direction, creating a gap allowing for slight movement in the radial direction and allowing the nut 25 to rotate with low rolling friction on the gaskets 100 and 101. The nut 25 is sealed to prevent the introduction of moisture into the connector 20. The gaskets 100 and 101 form that seal; they are carried in the nut 25 to prevent fluid permeation, and each is constructed from a material or combination of materials having deformable, resilient, shape-memory, and fluid impervious material characteristics. The first gasket 100 is disposed at the front end 42 of the inner post 21. The gasket 100 is seated against the curved front face 96 of the inner post 21 and compressed between the inner post 21 and the inner surface of the nut portion 34 of the nut 25. The other gasket 101 is disposed between the front end 42 of the inner barrel 27 and a channel 102 formed into the inner surface 36 of the nut portion 42 of the nut 25 proximate to the rear end 32 of the nut 25. The gasket 101 is disposed in a toroidal volume between the inner barrel 27 and the nut 25. The gasket 101 is seated into the outer surface 50 of the inner barrel 27 at the cuff 81, between the flange 82 and the sidewall 44, and is compressed axially and radially between the nut 25 and the inner barrel 27.

A lock washer 103, similar to or of one of the types disclosed in U.S. Pat. No. 6,712,631, filed Dec. 4, 2002, and U.S. patent application Ser. No. 15/217,903, filed Jul. 22, 2016, the disclosures of which are hereby incorporated by reference, is also disposed between the inner post 21 and the nut 25. The lock washer 103 is disposed in a toroidal volume between the inner post 21 and the nut 25. The lock washer 103, disposed between the flange 95 on the inner post 21 and an inwardly-directed flange 104 on the nut 24, applies a continuous tension between the nut 25 and the inner post 21 to prevent the separation of the nut 25 and the inner post 21. Further, the front end 82 of the inner barrel 27 is disposed in contact with the flange 104 and is held against the flange 104 by the fixed disposition of the cuff 81 in the channel 93.

Opposed from the inner post 21, carried on a rear portion of the inner barrel 27, is the compression collar 26. The compression collar 26 is a single, solid, rigid fitting applied to the rear end 43 of the inner barrel 27 for slidable and reciprocal movement thereon. The compression collar 26 includes a sidewall 110 having an open front end 111 and an opposed open rear end 112. The compression collar 26 has a first inner diameter B proximate to the front end 111 and a second, smaller inner diameter C proximate to the rear end 112. An internal, inwardly-directed shoulder 113 is formed on an inner surface 114 of the compression collar 26 and delineates the first inner diameter B from the second inner diameter C. The shoulder 113 defines an annular abutment face 115 directed forwardly.

Figure 3:
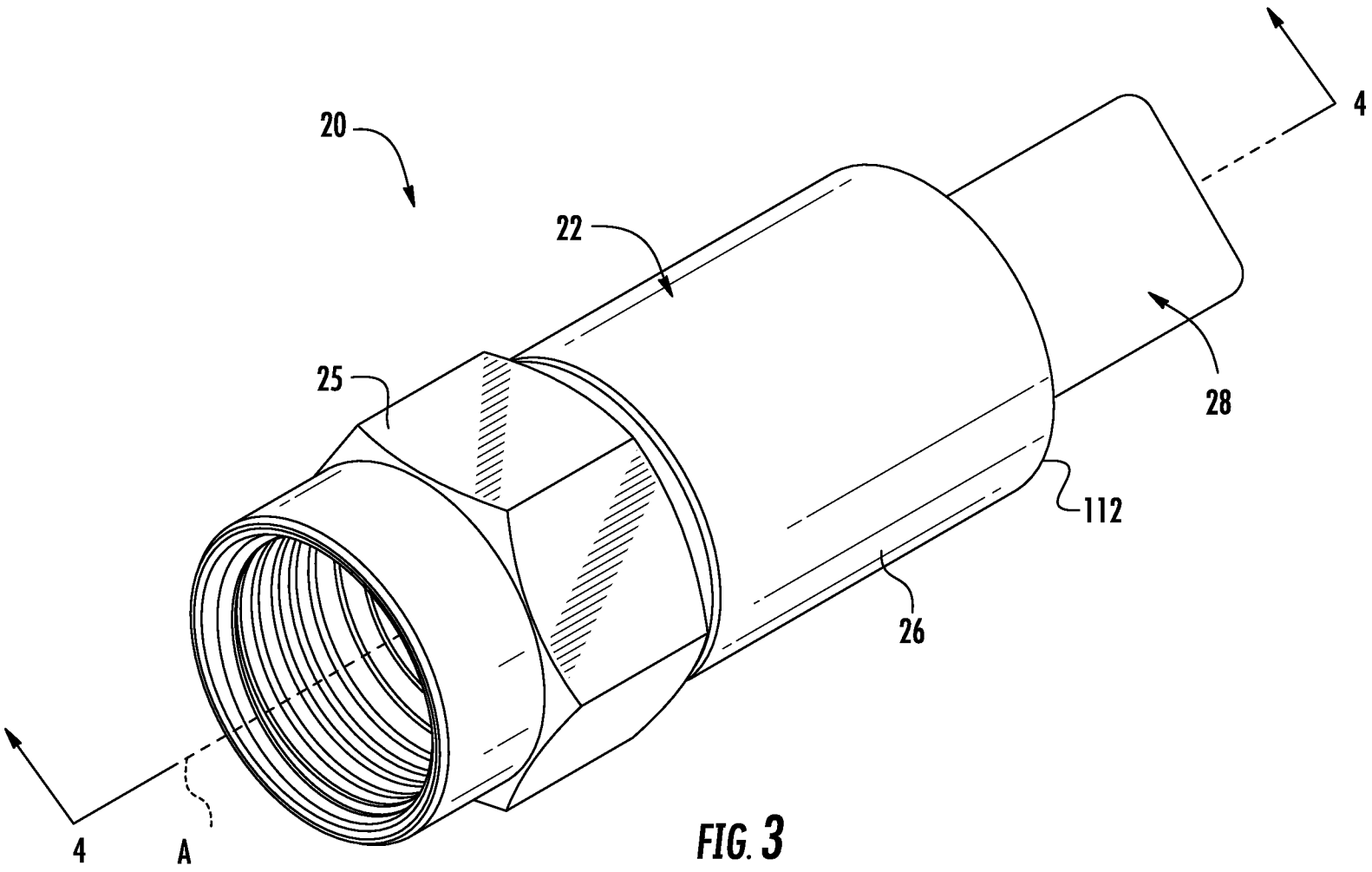
FIG. 3 is a perspective view of the connector of FIG. 1 in a compressed condition and applied on a coaxial cable.
Figure 4:
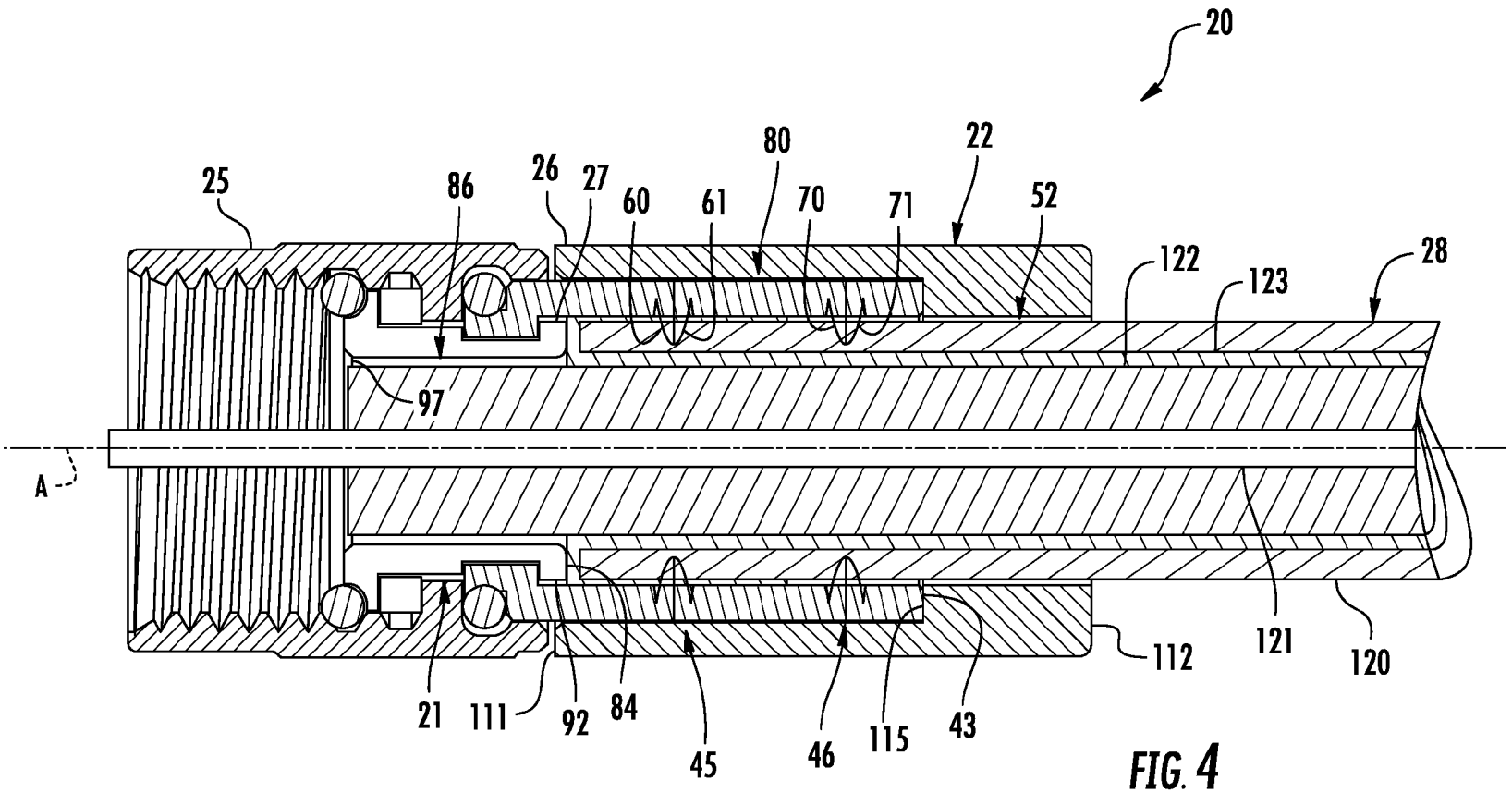
FIG. 4 is section view of the connector of FIG. 1 taken along the line 4-4 in FIG. 3, illustrating the connector in the compressed condition and applied on a coaxial cable.

In operation, the compression collar 26 is slid forwardly into an advanced position on the inner barrel 27 to compress the inner barrel 27 inward after a coaxial cable has been applied to the connector 20. FIGS. 1 and 2 show an uncompressed condition of the connector 20 in which no cable is yet applied to the connector 20, the inner barrel 27 is in an uncompressed and extended state, and the compression collar 26 is in a retracted position. FIGS. 3 and 4 show a compressed condition of the connector 20 on a coaxial cable 28. To arrange the connector 20 from the uncompressed condition free of a cable to the compressed condition applied on a cable, a prepared cable 28 is applied to the rear end 112 of the compression collar 26 and the rear end 43 of the inner barrel 27.

The cable 28 is prepared in a conventional fashion, by stripping off a portion of a jacket 120 at the free end of the coaxial cable 21 to expose a center conductor 121, a dielectric insulator 122, and a foil layer and flexible shield or braid 123. The dielectric insulator 122 is stripped back to expose a predetermined length of the center conductor 121, and the end of the shield 123 is turned back to cover a portion of the jacket 120. The end of the cable 28 is then introduced into the connector 20 through the rear end 112 of the compression collar 26. The jacket 23 is disposed against the compression collar 26, and the shield 123 is in contact with the inner post 21 and the inner barrel 27, in electrical communication with both. The coaxial cable 28 is advanced fully into the bores 52 and 86, such that the exposed front of the cable 28 is within the inner post 21 and against the lip 97. The lip 97 inhibits further forward axial movement of the cable 28. In this arrangement, the shield 123 is in contact with the rear end 84 of the inner post 21, maintaining electrical continuity. The flange 92 provides a relatively broad annular face against which the shield 123 abuts and contacts; the shield 123 contacts the inner post 21 only at the flange 92 at the rear end 84, and only in an annular plane transverse with respect to the axis A; the shield 123 does not contact the inner post 123 along an axial surface or plane. Further, the shield 123 contacts the inner post 21 at a bend in the shield 123, where the shield is folded back over the jacket 120. The shield 123 is in abutting relationship with, and is thus compressed axially against, the inner post 21 to maintain electrical continuity, shield the connector 20 from outside RF interference, and maintain electrical grounding of the connector.

With the cable 28 seated against the lip 97, the compression collar 26 is now slid forward into the advanced position shown in FIGS. 3 and 4. Preferably, this is accomplished with a compression tool which grips and compresses the connector 20 along the axis A between the front and rear of the connector 20. However, because the bore 52 is a continuous and uninterrupted void within the inner barrel 27, a user can apply the cable 28 into the connector 20 by hand and then attempt to move the compression collar 26 axially forward. In either method, the compression collar 26, being mounted for slidable movement on the inner barrel 27, moves axially forward over the inner barrel 27. The abutment face 115 contacts the rear end 43 of the inner barrel 27 and urges the rear end 43 of the inner barrel 27 axially forward. The thin-walled compression bands 45 and 46 are useful for crimping down on the cable 28 to provide a secure, non-damaging engagement between the connector 20 and the cable 28, in response to the axial compressive forces produced by the compression tool. The axial compressive forces subject the sidewall 44, thinned at the compression bands 45 and 46, to stress, thereby urging each to deform, bend, and compress inward in response to the stress.

The first and second wall portions of the compression bands 45 and 46 are oblique to the applied force, thus causing each to buckle and deform radially inward. The bends 62 and 72 are urged radially inwardly, and the first and second wall portions 60 and 61 of the forward compression band 45 are moved into a generally parallel position with each other, and are generally radially aligned with respect to the axis A. Similarly, the first and second wall portions 70 and 71 of the rear compression band 46 are moved into a generally parallel position with each other, and are generally radially aligned with respect to axis A. Compression continues until the compressible spaces 63 and 73 are closed, and the connector 20 is placed in the condition shown in FIGS. 3 and 4. In the compressed condition of the connector 20 and the advanced position of the compression collar 26, the front end 111 of the compression collar 26 is axially aligned with the rear end 84 of the inner post 21. This alignment provides increased rigidity to the connector 20. Although the process of moving the connector 20 from the uncompressed condition to the compressed condition is presented and described above as a series of sequential steps, it should be understood that the compression of the connector 20 on the coaxial cable 28 is preferably accomplished in one smooth, continuous motion, taking less than one second.

In the compressed condition of the connector 20, the inner diameter of the bore 52 is altered to a smaller inner diameter. The bends 62 and 72 define this new diameter. This reduction in diameter causes the jacket 120 to become crimped at the bend 62 and also at the bend 72. The barb 80, disposed between the two bends 62 and 72, further secures the application of the cable 28 to the connector 20; while the barb 80 allows forward axial movement of the compression collar 26 over the inner barrel 27, it prevents retraction or rearward movement of the compression collar 26 with respect to the inner barrel 27. With the compression collar 26 so secured on the inner barrel 27, and the cable 28 applied within the inner barrel 27, there is no way to non-destructively extend or relax the inner barrel 27 in an attempt to return the compression bands 45 and 47 to their original conditions; the compression collar 26 cannot be removed without damaging or destroying the connector 20. The first wall portions 60 and 70, and the second wall portions 61 and 71, are oriented transversely and generally tangentially to the axis A to support the compressed compression bands 45 and 46 in the compressed conditions, and to resist withdrawal of the coaxial cable 28 by preventing the outwardly-directed movement of the compression bands 45 and 46. The compression bands 45 and 46 are thereby each shaped into pawls that allow introduction and application of the cable 28 into the connector 20 but prevent removal of the cable 28 therefrom.

The rigid material characteristics of the inner post 21 prevent the inner post 21 from being damaged by the crimping. Furthermore, the shield 123 is axially registered with and in confronting abutment with the rear end 84 of the inner post, and as such, the continuity of the connection between the shield 123 and the inner post 21 is maintained so that a signal transmitted through the connector 20 is not leaked outside of the connector 20, so that outside RF interference does not leak into the connector 20, and so that the connector 20 remains electrically grounded. The compression collar 26, now fit over and encircling the compressed inner barrel and the inner post 21, with the cable 21 therebetween, provides increased rigidity of the connector 20.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A coaxial cable connector comprising:

an inner barrel having a longitudinal axis, a front end, a rear end, and a compression band between the front and rear ends;

a compression collar mounted to the inner barrel for axial movement over the inner barrel from a retracted position to an advanced position;

an inner post having a front end and a rear end;

the front end of the inner barrel is carried at and on the rear end of the inner post; and in response to axial movement of the compression collar over the inner barrel, the compression band compresses inward.

2. The coaxial cable connector of claim 1, wherein in the advanced position of the compression collar, a front end of the compression collar is axially aligned with the rear end of the inner post.

3. The coaxial cable connector of claim 1, wherein the rear end of the inner post terminates just behind the coupling nut.

4. The coaxial cable connector of claim 1, further comprising a continuous and uninterrupted void defined within the inner barrel coextensive to the compression collar.

5. The coaxial cable connector of claim 1, further comprising a plurality of compression bands formed in the inner barrel between the front and rear ends of the inner barrel.

6. The coaxial cable connector of claim 1, further comprising:

an outer surface of the inner barrel;

an inner surface of the compression collar; and an annular barb carried between the outer surface of the inner barrel and the inner surface of the compression collar, the annular barb allowing forward axial movement of the compression collar over the inner barrel and preventing rearward axial movement of the compression collar over the inner barrel.

7. The coaxial cable connector of claim 1, wherein the compression band moves between an uncompressed condition and a compressed condition in response to axial compression of the coaxial cable connector.

8. The coaxial cable connector of claim 7, wherein movement of the compression band from the uncompressed condition to the compressed condition shapes the compression band into a pawl that allows introduction of a cable into the coaxial cable connector and then prevents removal of the cable therefrom.

9. A coaxial cable connector comprising:

an inner post having a front end and a rear end;

an inner barrel having a front end, a rear end, and a compression band therebetween;

a compression collar carried on the inner barrel for axial movement over the inner barrel from a retracted position to an advanced position to impart compression to the compression band in the inner barrel;

the front end of the inner barrel is mounted on and proximate to the rear end of the inner post; and the rear end of the inner post is axially forward of the compression band.

10. The coaxial cable connector of claim 9, wherein in the advanced position of the compression collar, a front end of the compression collar is axially aligned with the rear end of the inner post.

11. The coaxial cable connector of claim 9, wherein the rear end of the inner post terminates just behind the coupling nut.

12. The coaxial cable connector of claim 9, further comprising a continuous and uninterrupted void defined within the inner barrel coextensive to the compression collar.

13. The coaxial cable connector of claim 9, further comprising a plurality of compression bands formed in the inner barrel between the front and rear ends of the inner barrel.

14. The coaxial cable connector of claim 9, further comprising:

an outer surface of the inner barrel;

an inner surface of the compression collar; and an annular barb carried between the outer surface of the inner barrel and the inner surface of the compression collar, the annular barb allowing forward axial movement of the compression collar over the inner barrel and preventing rearward axial movement of the compression collar over the inner barrel.

15. The coaxial cable connector of claim 9, wherein the compression band moves between an uncompressed condition and a compressed condition in response to axial compression of the coaxial cable connector.

16. The coaxial cable connector of claim 15, wherein movement of the compression band from the uncompressed condition to the compressed condition shapes the compression band into a pawl that allows introduction of a cable into the coaxial cable connector and then prevents removal of the cable therefrom.

17. A coaxial cable connector comprising:

an inner post having a front end and a rear end;

an inner barrel having a front end, a rear end, and a compression band therebetween;

a compression collar carried on the inner barrel for axial movement from a retracted position to an advanced position, wherein said axial movement compresses the compression band in the inner barrel; and the front end of the inner barrel is mounted on and proximate to the rear end of the inner post.

18. The coaxial cable connector of claim 17, wherein in the advanced position of the compression collar, a front end of the compression collar is axially aligned with the rear end of the inner post.

19. The coaxial cable connector of claim 17, wherein the rear end of the inner post terminates just behind the coupling nut.

20. The coaxial cable connector of claim 17, further comprising a continuous and uninterrupted void defined within the inner barrel coextensive to the compression collar.

21. The coaxial cable connector of claim 17, further comprising a plurality of compression bands formed in the inner barrel between the front and rear ends of the inner barrel.

22. The coaxial cable connector of claim 17, further comprising:

an outer surface of the inner barrel;

an inner surface of the compression collar; and an annular barb carried between the outer surface of the inner barrel and the inner surface of the compression collar, the annular barb allowing forward axial movement of the compression collar over the inner barrel and preventing rearward axial movement of the compression collar over the inner barrel.

23. The coaxial cable connector of claim 17, wherein the compression band moves between an uncompressed condition and a compressed condition in response to axial compression of the coaxial cable connector.

24. The coaxial cable connector of claim 23, wherein movement of the compression band from the uncompressed condition to the compressed condition shapes the compression band into a pawl that allows introduction of a cable into the coaxial cable connector and then prevents removal of the cable therefrom.

* * * * *